United States Patent [19]

Sindel

[11] Patent Number: 4,756,297

[45] Date of Patent: Jul. 12, 1988

[54] AIR WEAPON WITH NON-CIRCULAR AIR PRESSURE CHAMBER

[75] Inventor: Gerhard Sindel, Ansbach, Fed. Rep. of Germany

[73] Assignee: Fritz Barthelmes KG, Heidenheim-Oggenhausen, Fed. Rep. of Germany

[21] Appl. No.: 441,492

[22] Filed: Nov. 15, 1982

[30] Foreign Application Priority Data

Mar. 11, 1982 [DE] Fed. Rep. of Germany ..... 3208798

[51] Int. Cl.[4] ..... F41B 11/00

[52] U.S. Cl. ..... 124/67

[58] Field of Search ..... 124/66, 67, 68, 69, 124/70, 37, 27, 28

[56] References Cited

U.S. PATENT DOCUMENTS

| | | | |
|---|---|---|---|
| 2,150,288 | 3/1939 | Möller | 124/67 |
| 2,820,445 | 1/1958 | Tratsch | 124/67 |
| 2,888,768 | 6/1959 | Taylor | 124/67 |

FOREIGN PATENT DOCUMENTS

| | | | |
|---|---|---|---|
| 1428628 | 10/1970 | Fed. Rep. of Germany | 124/69 |
| 1703166 | 11/1970 | Fed. Rep. of Germany | 124/67 |
| 145220 | 4/1936 | Poland | 124/27 |
| 365548 | 3/1973 | U.S.S.R. | 124/67 |

*Primary Examiner*—Richard T. Stouffer

*Attorney, Agent, or Firm*—Walter H. Schneider

[57] ABSTRACT

An air weapon comprising a hand grip and a generally tubular-shaped housing connected thereto having front and rear ends confining a tubular pressure chamber. The pressure chamber is of non-cylindrical configuration thereby providing a pressure chamber of increased volume over that obtainable with a cylindrically shaped chamber without detrimentally affecting the external appearance of the weapon. A cylindrical barrel for discharging a projectile from the weapon is positioned within and coaxial to the pressure chamber. A piston conforming to the configuration of the pressure chamber and adapted to move within the pressure chamber along its axis surrounds the barrel with its piston head facing the rear end of the housing. A piston spring also surrounds the barrel and is positioned against the piston head at one of its ends and against the front end of the housing at its other end. Tensioning means pivoted at the front of the housing cooperate with a linkage mechanism to move the piston head into a position in the pressure chamber adjacent the front of the housing against the pressure of the piston spring. Activation of trigger means releases the piston spring tension causing the piston to move in the pressure chamber compressing the air therein and forcing it into a bore hole at the rear end of the housing thereby causing a projectile to be forcibly discharged from the weapon through the barrel.

4 Claims, 3 Drawing Sheets

1
9
12
14
16
16a
16b
24
25
37
38
20
21
18
13
7
8
4
27
28
26
17
15

AIR WEAPON WITH NON-CIRCULAR AIR PRESSURE CHAMBER

BACKGROUND OF THE INVENTION

1. Field of the Invention

The present invention relates generally to improvements in or relating to air-pressure, or air-powered, weapons, also referred to as spring-air weapons and the like weapons powered by air pressure created by the release of a spring and plunger, with the pressure being developed at the moment of discharge. More particularly, the present invention relates to air-powered weapons, hereinafter also referred to as air weapons, having a barrel member with at least one rearward barrel opening and also having a housing with at least one pressure chamber, and further including a piston movably disposed in the pressure chamber in said housing, with the piston being adapted to be brought, by means of a linkage mechanism operatively connectible to the piston, against the pressure of a spring means, into a position in which it is held under tension, corresponding to the condition in which the weapon is cocked or ready to be fired.

2. Description of the Prior Art

In the customary construction of such air weapons, the barrel is a drop barrel and the tensioning or cocking of the piston is achieved by the cocking, or breaking of the breech, movement. The volume of the pressure chamber, for one, is a criterion of the effective efficiency and, as well, for the overall outer dimensioning of such air weapons. The known weapons of this class always exhibit a circular or annular piston surface when viewed in cross section and include a pressure chamber which is adapted accordingly thereto with its cross section. The diameter of the piston determines, to a considerable extent, the width of the housing of the weapon, and the length is a function of the necessary piston stroke for a required volume.

For the introduction of compressed air into the barrel there are provided in the known designs for this purpose one or several connecting bores or passages, which, however, require a relatively large amount of space if they are to be adequately dimensioned.

SUMMARY OF THE INVENTION

There has continued to remain, therefore, a need for improving the air weapons of the class described.

It is an object of the present invention to provide a weapon which is particularly convenient to hold and handle.

It is also an object of the present invention to provide a weapon which is of compact size with the smallest possible overall dimensions.

It is further an object of the present invention to provide a weapon of the class indicated which is adapted to provide for good effective efficiencies.

These various objects are met in accordance with this invention by a compressed-air, or air-powered, weapon comprising a housing which includes at least one pressure chamber, and comprising a piston movably arranged in said chamber in said housing and adapted to be moved between a first position, corresponding to the condition in which it is held under tension and the weapon is ready to be fired, and a second position, corresponding to the condition after firing of the weapon. The weapon also comprises means for exerting spring tension upon the piston to hold it in said first position, linkage means operatively connectible to said piston for moving it between said first and said second positions, and a barrel, or barrel member, operatively connectible to said housing, with said barrel member having at least one rearwardly arranged barrel opening, or barrel entry, and the pressure chamber and the piston, respectively, exhibiting a cross-sectional configuration which is a departure from the circular shape.

By such configuration, the weapon can be produced narrower and shorter than known designs and with equal or greater effective efficiency at comparable dimensions.

For this there may be provided that the pressure chamber and the piston, respectively, exhibit an oval shape or the shape of an ellipse when viewed in cross section. As well, the pressure chamber and the piston can exhibit, respectively, a central section with walls which are parallel with respect to each other and with semi-circular or arcuate sections being contiguous, or joined, to the central wall sections.

Such configurations provide a considerable increase of the pressure chamber, and the volume thereof, without detrimentally affecting the overall appearance of the weapon.

An advantageous embodiment of the invention contemplates that the piston is located in the forward region of the weapon, when the weapon is in the cocked condition, and the pressure chamber is located therebehind when viewed in the direction of the barrel.

In this manner, the air which is compressed in the chamber is advanced to the rearward opening of the barrel over the shortest distance and rather centrally, at low aerodynamic losses.

For the introduction of the air there can be provided that the rearward end of the barrel is supported by way of segmental webs or cross pieces in the housing, whereby the spaces between such segmental pieces provide the air channels or passages between the pressure chamber and the rearward barrel opening.

The segmental or cross pieces can be arranged as separate parts in the housing, they may be secured to the barrel, or to a part on the housing of the weapon, and they may also be integral parts thereof.

It is also of advantage herein when the cross pieces are arranged of the inner circumference of a closure cap which has a borehole or passage for receiving therein the rearward end of the barrel, and which closure cap is adapted to seal off the rearward end of the pressure chamber.

In accordance with yet another advantageous embodiment of the invention the air weapon comprises a tensioning or cocking handle which is pivotally secured with its one end in the forward region of the weapon and, in turn, the end of a tensioning bar or rod is pivotally or swingably secured to the tensioning handle, whereas the other end of the tensioning rod is pivotally journalled or linked to the one end of a push rod or bar, with the other end of the push bar being connectible to the piston for the cocking or tensioning thereof.

Instead of the use of a drop barrel of known weapons, the cocking or readying of the weapon in accordance with this invention is achieved by tensioning the piston with a separate tension or cocking handle.

This serves to achieve a constant attitude or state of the barrel, and the danger of inaccuracies during aiming is substantially avoided.

The tensioning or cocking handle can extend in the longitudinal direction of the barrel, and for tensioning of the piston it can be adapted to be swingable from a position which is at least substantially parallel to the barrel, in a direction upwardly and forwardly.

With respect to known constructions in which the aiming devices are either fully or in part arranged on a clamping device extending parallel to the barrel, the arranging of the tensioning handle furthermore provides the advantage that notch-and-bead are secured permanently to the housing of the weapon and, accordingly, are absolutely fixed in the same position with respect to the barrel.

It is also of advantage that the tensioning handle surrounds or encloses, at least in part, the upper portion of the housing of the weapon.

By way of this measure there can be achieved a weapon which is visually very appealing. For this, for example, the tensioning handle can be brought into close proximity to the outer contour of the weapon such that it will not be of distracting appearance. The shortening of the weapon and the absence of the drop barrel will further enhance the visual impression and impact, which will be very close to that of a genuine fire-weapon.

For the precise tensioning or cocking, and guiding, of the piston, it can be arranged that the tensioning handle comprises, on each side of the weapon, a lateral part, and to each of these there can be connected a respective tensioning rod. The two push rods or bars associated therewith, in turn, are connectible to one another, respectively, at the ends which are connected to the tensionig rods, by means of a connecting member, for example a connecting pin or similar connector, which is guided by a recess in the housing of the weapon.

In a simple manner there can be provided that the rearward end of the tensiong handle sealingly closes the rearward entrance into the barrel, when the weapon is in the cocked condition. For this, there may be arranged a cover plate or lid at the tensioning handle.

The cover plate then seals the rearward opening of the closure cap in the closed condition.

The advantage of a separate closure cap, which is securely attached to the housing of the weapon, resides in a simple assembly and disassembly of individual parts of the weapon, particularly the piston, the piston tensioning spring, and the attendant seal rings. For this, it is only necessary that the part of the closure cap which extends into the interior of the housing of the weapon has the same diameter as the pressure chamber. The barrel is thereby supported and/or journalled in a borehole of the closure cap, whereby there are provided, by means of the cross pieces, passages or openings for the compress air.

Further embodiments of the invention and other inventive features are contained in the claims.

DESCRIPTION OF THE DRAWINGS

In the drawings, which illustrate that which is presently regarded as the best mode of carrying out the invention.

DESCRIPTION OF THE PREFERRED EMBODIMENT

Figure 1:
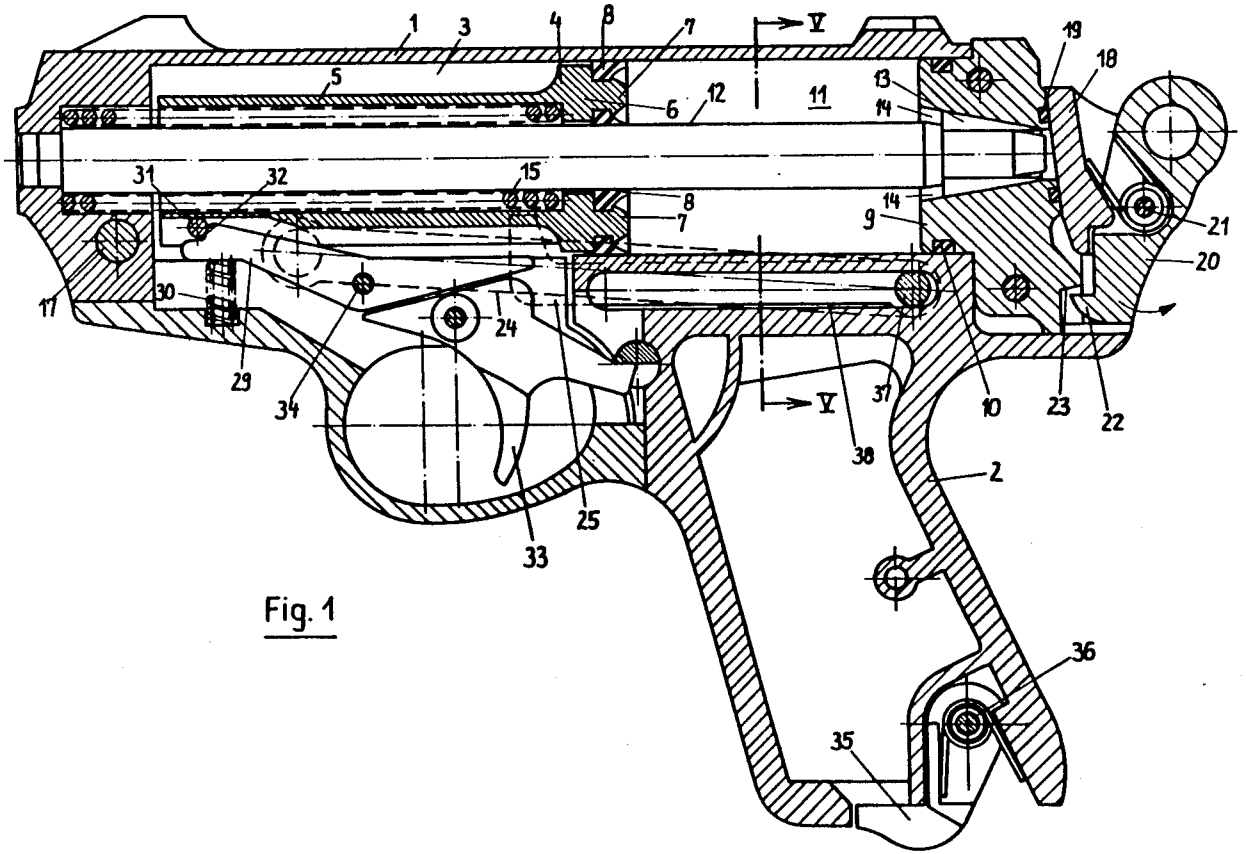
FIG. 1 is a cross-sectional view of an air weapon according to this invention.

Referring now to the figures of the drawings, the shown air pistol is generally of known construction and in the following there are only described in greater detail those components which are material to the understanding of the inventive concepts.

The air pistol comprises a housing 1 with a handle or grip 2. In the upper portion of the housing 1 there is arranged a borehole or similar hollow cylindrical chamber, generally designated by the numeral 3. A piston 4 is arranged in the borehole or chamber 3. The piston 4 includes a spring guide portion 5 and an effective front or head plate 6. The head plate 6 is on its front face provided with mushroom-shaped pins 7 which are adapted to retain a sealing sleeve or gasket ring 8 on head plate 6 of the piston 4. The borehole 3 of housing 1 is closed at the rearward end of the housing 1 by means of a closure or end cap 9. The end cap 9 is furnished with a sealing ring 10 and securely connected to the housing 1 in any desired manner. When the piston 4 is under tension, corresponding to the condition in which the pistol is cocked or ready to be fired, there will be a pressure chamber 11 between the head plate 6 and the end cap 9.

Figure 4:
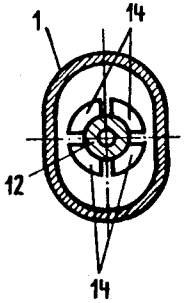
FIG. 4 is a cross-sectional view taken along the line IV—IV of FIG. 2
Figures 3, 5:
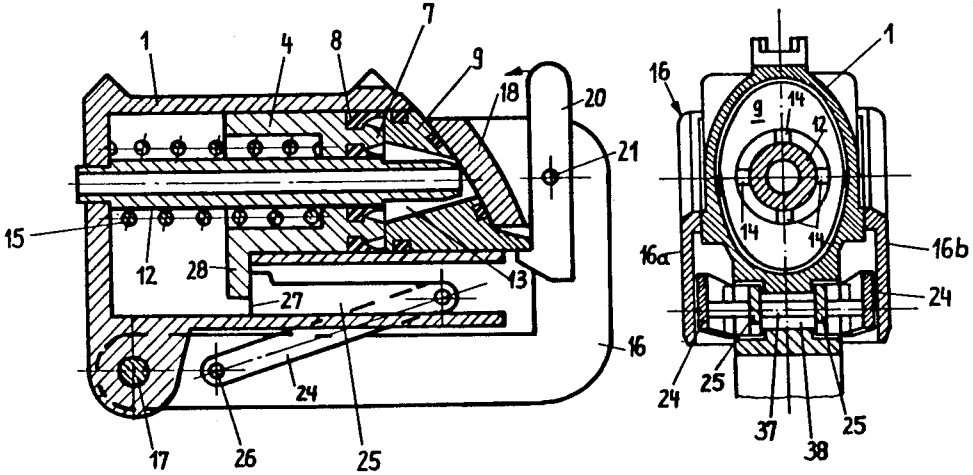
FIG. 3 is a view similar to that of FIG. 2, with the tensioning handle being shown in the position corrsponding to its closed condition, with the piston being shown in the released position.
FIG. 5 is a cross-sectional view through the upper part of the weapon, taken along the line V—V of FIG. 1.

As can be seen with reference to FIG. 4 and FIG. 5, the cross-sectional configuration of the pressure chamber 11 and, thereby, also the cross section of the piston 4, as well as that of the front plate 6, is a departure from the circular shape. Thus, in FIG. 4 there is shown an oval shape, i.e. a shape comprised, in cross section, of two wall portions which are parallel to one another and which are joined by two semicircular portions to complete the oval. FIG. 5, in turn illustrates an elliptical shape for the chamber 11.

The piston 4 is arranged coaxially with respect to a barrel 12, with the forward end of barrel 12 being directly secured to the housing 1, while the rearward end, which has at least one opening or entry for compressed air, is supported in a borehole or passage 13 of end cap 9. The support is provided by several segmental webs or cross pieces 14 which are correspondingly distributed about the inner circumference of the end cap 9. The cross pieces 14 can be integral with the end cap 9, with the unit being cast. As can be seen in FIG. 4 and FIG. 5, there are provided four cross pieces 14 about the circumference, with correspondingly large passages being provided which serve as passages for compressed air, which can thus be passed to the rearward, open, end of the barrel 12.

A coil or spiral spring 15 is arranged between the outer circumference of the barrel 12 and the inner circumference of the guide portion 5 of piston 4, and this spring produces the pre-tensioning of the piston 4.

A tensioning or cocking lever or handle 16 is pivotally or swingably secured with one end in the forward region of the weapon to a pin or pivot pin 17. The tensioning handle is not shown in FIG. 1. The tensioning handle 16 is comprised of two lateral or side parts 16*a* and 16*b*, respectively, which are located on each side of the weapon in the closed condition, as is indicated in FIG. 5. At the forward end, each side part is linked, on its respective side of the weapon, to the pivot pin 17. At their respective rearward ends, both side parts are joined to one another by a cover plate or lid 18 which is transversely arranged with respect to the rearward ends. The length of handle 16, or the side parts 16*a* and 16*b*, respectively, is selected in such a way that the cover plate 18 is positioned sealingly in front of the borehole 13. For this there can also be provided, a ring gasket or seal 19 in the end cap 9.

Furthermore, at the rearward end, and particularly at the transversely positioned cover plate 18, there is swingably or pivotally secured a locking or detent arm 20 which is mounted on a pivot pin 21. The lower end of the detent arm 20 includes a catch 22 which is adapted to reach beneath a shoulder 23 of the end cap 9, or some other part of the housing 1. The detent arm 20 serves to secure the position of the tensioning handle 16 when this is in its closed condition. For tensioning it is merely required that the detent arm 20 be swung in the direction of the arrow, FIG. 1, i.e. in counterclockwise direction, whereby the tensioning handle 16 can be swung upwardly about the pivot pin 17.

Figure 2:
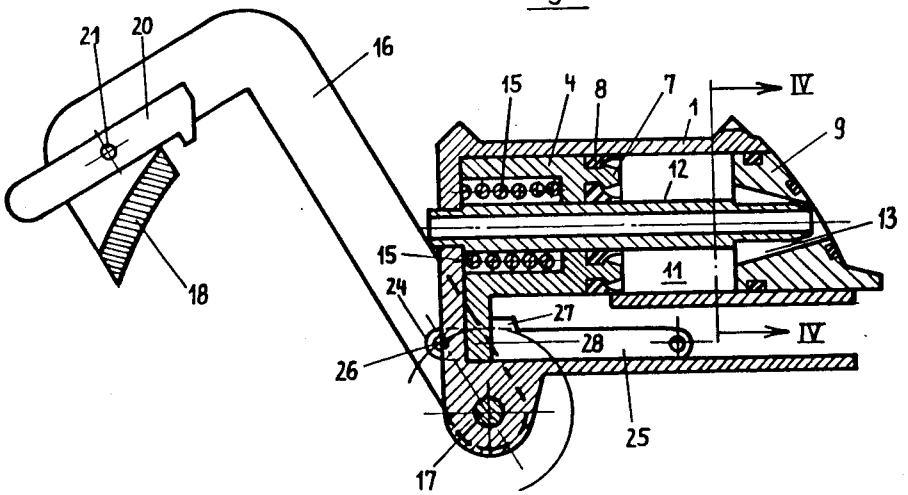
FIG. 2 is a cross section through the upper part of the weapon, which in principle is alike to that of FIG. 1, with the tensioning handle being shown during the tensioning of the piston.

A linkage mechanism for tensioning piston 4 comprising a tensioning bar 24 and a push bar 25 is located on each side of housing 1 as shown in FIGS. 2 and 3. One end 26 of each tensioning bar 24 is movably joined to a side part 16*a* and 16*b* of tensioning handle 16 by means of a pivot arrangement. The other end of each tensioning bar 24 is pivotally connected to its corresponding push bar 25. The opposite ends of push bars 25 comprise thrust surfaces 27 adapted to cooperate with a stop 28 on the piston 4. Thrust surface 27 can be formed as a catch which is guided in a longitudinal slot at the outer side of spring guide 5. The corresponding cooperating ends of tensioning bars 24 and push bars 25 are pivotally connected by means of pin 37 extending through recess 38 in housing 1 as shown in FIGS. 1 and 5, thereby providing a guide to control the movement of the linkage mechanism.

For tensioning or cocking the air weapon, tensioning handle 16 is swung from its locked position at the rear of the weapon upwardly and in a forward direction about pivot pin 17. For this purpose, detente arm 20 is swung in the direction of the arrow shown in FIGS. 1 and 3, i.e., in a counterclockwise direction. By means of the linkage mechanism comprising tensioning bars 24 and push bars 25, piston 4 is moved to the front of the weapon, or to the left as shown in FIG. 1, against the pressure of spring 15 thereby assuming its cocked position as illustrated in FIG. 2.

During the tensioning procedure, one end of a trigger member 29 is moved downwardly through a short distance against the force of a cocking spring 30 by means of a transverse pin 31 carried in a bore in spring guide 5, thereby permitting step 32 to engage pin 31 so as to hold trigger member 29 in the cocked position against the pressure of spring 30. After insertion of a projectile into the rear end of barrel 12, tensioning handle 16 can be returned to the closed position thereby sealing borehole 13 of pressure chamber 11 as shown in FIGS. 1 and 3.

The weapon is fired by pulling trigger 33 thereby rotating trigger member 29 about shaft 34. This movement of trigger member 29 compresses spring 30 thereby releasing traverse pin 31 and causing piston 4 to move towards the rear of the weapon, i.e., to the right as shown in FIG. 1. Air compressed in pressure chamber 11 by the rearward movement of piston 4 is forced through the passages formed by cross pieces 14 into borehole 13 causing the projectile to discharge from the weapon through barrel 12.

Ammunition can be stored in the handle 2 which is provided on its underside with a cover 35 pivotally mounted on shaft 36. By pivoting cover 35 about shaft 36, ammunition can be readily stored and removed from the handle.

Reference in this disclosure to details of the specific embodiment is not intended to restrict the scope of the appended claims, which themselves recite those features regarded as essential to the invention.

I claim:

1. In an air-pressure hand weapon comprising a hand grip; a housing connected thereto defining a tubular chamber; a hollow barrel supported in said tubular chamber and extending the length thereof; a piston surrounding said barrel including a piston head sealably engaging the wall of said tubular chamber whereby the volume of said tubular chamber between said piston head and the rear wall of said housing constitutes an air pressure chamber; spring tensioning means including a spring surrounding said barrel and associated with said piston head and the front of said housing for placing said piston under spring tension; and trigger means for releasing said spring tension thereby causing said piston to compress the air in said air pressure chamber forcing it through orifices into a bore hole at the rear of said air pressure chamber whereby a projectile placed in said bore hole is propelled by said compressed air through said barrel and discharged from said weapon, the improvement in which said tubular chamber wall and said piston head are shaped so as to impart to said air pressure chamber a configuration that is non-circular when viewed in cross section, the length said tubular chamber being selected in relation to said non-circular configuration so as to provide the necessary volume in said air pressure chamber required to propel a projectile through said barrel at optimum efficiency, the non-circular configuration of said air pressure chamber permitting the housing of said weapon to be of smaller overall dimensions than the housing of a weapon having an air pressure chamber of corresponding volume but of circular configuration.

2. An air weapon according to claim 1 in which said tensioning means comprises a tension handle including two side parts conforming to the configuration of and adapted to lay flat against opposite sides of the external surface of said housing, said side parts being pivotably connected by one of their ends to the front of said housing; and a linkage mechanism including two tensioning bars one end of each of which is pivotably connected at the front of said housing to a separate side part and the opposite end of each of which is pivotably connected to separate push bars, the opposite ends of said push bars being adapted to contact a stop on said piston when said tension handle is moved in a counterclockwise direction.

3. An air weapon according to claim 2 in which said pressure chamber, when viewed in cross section, is elliptical in configuration.

4. An air weapon according to claim 2 in which said pressure chamber, when viewed in cross section, has parallel side walls joined by semicircular end walls.

* * * * *